US005395511A

United States Patent [19]

Kubo et al.

[11] Patent Number: 5,395,511

[45] Date of Patent: Mar. 7, 1995

[54] PROCESS FOR CONVERTING HEAVY HYDROCARBON OIL INTO LIGHT HYDROCARBON FUEL

[75] Inventors: Junichi Kubo; Tadakazu Yamashita; Osamu Kato, all of Yokohama, Japan

[73] Assignee: Nippon Oil Co., Ltd., Tokyo, Japan

[21] Appl. No.: 81,981

[22] Filed: Jun. 23, 1993

[30] Foreign Application Priority Data

Jun. 30, 1992 [JP] Japan ..... 4-194668
Feb. 24, 1993 [JP] Japan ..... 5-059683

[51] Int. Cl.[6] ..... C10G 47/18; C10G 47/32; C10G 45/50

[52] U.S. Cl. ..... 208/111; 208/56; 208/58; 208/67; 208/107; 208/110; 208/145

[58] Field of Search ..... 208/111, 57, 58, 56, 208/107, 110, 145, 67

[56] References Cited

U.S. PATENT DOCUMENTS

| | | | |
|---|---|---|---|
| 3,413,212 | 11/1968 | Weisz | 208/120 |
| 4,324,935 | 4/1982 | Wernicke et al. | 208/57 |
| 4,363,716 | 12/1982 | Greene | 208/57 |
| 4,389,303 | 6/1983 | Simo et al. | 208/56 |
| 4,604,186 | 8/1986 | Lutz et al. | 205/50 |
| 4,615,791 | 10/1986 | Choi et al. | 208/56 |
| 4,640,765 | 2/1987 | Kubo | 208/110 |
| 4,659,454 | 4/1987 | Varghese et al. | 208/217 |
| 4,857,168 | 8/1989 | Kubo et al. | 208/58 |
| 4,966,679 | 10/1990 | Kubo et al. | 208/58 |

FOREIGN PATENT DOCUMENTS

| | | |
|---|---|---|
| 272038 | 6/1988 | European Pat. Off. . |
| 784136 | 4/1954 | United Kingdom . |

*Primary Examiner*—Linda Skaling
*Assistant Examiner*—Lorna M. Douyon
*Attorney, Agent, or Firm*—Ostrolenk, Faber, Gerb & Soffen

[57] ABSTRACT

A process is provided for converting a heavy hydrocarbon oil into light hydrocarbon fuels by thermal cracking or hydrocracking, which comprises adding to about 100 parts by weight of the heavy hydrocarbon oil feedstock (A) about 0.1 to 50 parts by weight of a substance (B) which is a hydrogenated oil obtained by aromatic ring hydrogenation of about 430°–600° C. thermal-treated or cracked petroleum feedstock product oil boiling higher than about 200° C. to hydrogenate abot 20 to 90% of the aromatic rings present.

18 Claims, No Drawings

PROCESS FOR CONVERTING HEAVY HYDROCARBON OIL INTO LIGHT HYDROCARBON FUEL

BACKGROUND OF THE INVENTION

1. Field of the Invention

The present invention relates to a process for converting heavy hydrocarbon oils into light hydrocarbon fuels. It particularly relates to an improved thermal cracking or hydrocracking process which produces less carbonaceous matter during operation.

2. Background Art

Thermal cracking or hydrocracking has been practiced as a major process for converting heavy oils into light fuels; however, a disadvantage for the process is a marked carbon formation during operation and the relatively low yield of liquid product.

Although thermal cracking process is conducted at a moderate pressure and is not expensive, it fails to carry out a long-term continuous operation and is difficult to obtain high conversions due to the marked carbon deposition; therefore, the yields of distillate fuels are low.

When hydrocracking is employed in the conversion of asphaltene-containing heavy oils, it also fails to carry out a stable continuous operation because of large pressure drop due to carbon deposition. Moreover, the operating conditions and continuous operating duration are limited by a sharp decrease in catalytic activity due to increased carbon formation.

Accordingly, it is a principal object of the present invention to provide an improved process for converting heavy hydrocarbon oils by thermal cracking or hydrocracking into light hydrocarbon fuels wherein the process can increase the continuous operating duration and the yields of liquid products by decreasing the foregoing carbon deposition and thereby setting up more profitable operating conditions.

It is known in the art that a hydrogen-donor substance may be added to the reaction zone in thermal cracking or hydrocracking of heavy hydrocarbon oils in order to prevent the carbon deposition. Oil & Gas Journal, VOL. 85, NO. 28, pp. 84–87, 1987 for example, disclosed a catalytic cracking process wherein at least part of cracked products is hydrogenated and the resulting hydrogenated product is added to the reaction zone. However, in conventional processes a great amount of additive is required because the conventional additive does not have a hydrogen donating ability in a large enough amount. The amount of hydrogen donor substance to be added usually amounts to 30% to several times the amount of heavy hydrocarbon feedstock, on a weight basis.

The present invention is based on a discovery that a good hydrogen-donor substance can be obtained by aromatic ring hydrogenation of a petroleum fraction, and by addition of the substance at reduced amounts, an improved inhibitory effect on carbon deposition can be produced when compared to those of a conventional hydrogen-donor substance.

SUMMARY OF THE INVENTION

According to a first aspect of the present invention, there is provided a process for converting heavy hydrocarbon oils into light hydrocarbon fuels by thermal cracking, which comprises:

to about 100 parts by weight of a heavy hydrocarbon oil feedstock (A) being added about 0.1 to 50 parts by weight of a substance (B) selected from any one of the following (I) and (II), wherein (I) are hydrogen-donor substances each of which comprises a hydrogenated oil obtained by aromatic ring hydrogenation of a thermal-cracked product oil boiling higher than about 200° C., said aromatic ring hydrogenation being conducted so as to hydrogenate about 20 to 90% of the aromatic rings present in the feedstock, said thermal cracking being conducted at about 430° to 600° C. by using a petroleum feedstock, and (II) are hydrogen-donor substances each of which comprises a hydrogenated oil obtained by aromatic ring hydrogenation of a thermal-treated product oil boiling higher than about 200° C., said aromatic hydrogenation being conducted so as to hydrogenate about 20 to 90% of the aromatic rings present in the product oil, said thermal treating being conducted at about 430° to 600° C. by using a catalytic-cracked or catalytic-reformed product boiling higher than about 200° C., said catalytic cracking or catalytic reforming being conducted by using a petroleum feedstock.

According to a second aspect of the present invention, there is provided a process for converting heavy hydrocarbon oils into light hydrocarbon fuels by hydrocracking, which comprises:

to about 100 parts by weight of the heavy hydrocarbon oil feedstock (A) being added about 0.1 to 50 parts by weight of a substance (B) selected from any one of the following (I) and (II), wherein (I) are hydrogen-donor substances each of which comprises a hydrogenated oil obtained by aromatic ring hydrogenation of a thermal-cracked product oil boiling higher than about 200° C., said aromatic ring hydrogenation being conducted so as to hydrogenate about 20 to 90% of the aromatic rings present in the product oil, said thermal cracking being conducted at about 430° to 600° C. by using a petroleum feedstock, and (II) are hydrogen-donor substances each of which comprises a hydrogenated oil obtained by aromatic ring hydrogenation of a thermal-treated product oil boiling higher than about 200° C., said aromatic ring hydrogenation being conducted so as to hydrogenate about 20 to 90% of the aromatic rings present in the product oil, said thermal treating being conducted at about 430° to 600° C. by using a catalytic-cracked or catalytic-reformed product boiling higher than about 200° C., said catalytic cracking or catalytic reforming being conducted by using a petroleum feedstock.

DETAILED DESCRIPTION OF THE PREFERRED EMBODIMENTS

"Heavy hydrocarbon oil (A)" refers to a hydrocarbon oil, 50% or more of which boils higher than 350° C. Examples of such heavy hydrocarbon oil include topped crudes; vacuum residues; various oils from coal, oil sands, oil shales and bitumens.

The foregoing "petroleum feedstock" refers to a feedstock selected from the group consisting of crude oils; crude vacuum distillates boiling between 300° C. and 600° C.; naphtha thermal cracking residues; catalyst cycle stocks, catalyst slurry oils and decanted oils (DCO) in FCC units; catalytic reforming residues from naphtha; thermal cracking tars from crude oils; or mixture thereof.

"Hydrogen-donor substance (I)" refers to a hydrogenated oil obtained by aromatic ring hydrogenation of a thermal-cracked product oil boiling higher than 200° C., preferably 200° to 600° C. in thermal cracking of a petroleum feedstock at 430° to 600° C., preferably 450° to 550° C., for about 10 to 120 minutes wherein said hydrogenation is carried out to the extent that about 20 to 90%, preferably about 30 to 85% by weight of the aromatic rings present in the thermally cracked product oil is converted to naphthenes.

The hydrogenated oils have a boiling point higher than about 330° C., preferably about 350° to 600° C.

"Hydrogen donor substance (II)" refers to a hydrogenated oil obtained by aromatic ring hydrogenation of a thermal-treated product oil boiling higher than about 200° C., preferably about 200° to 600° C., said hydrogenation being conducted so as to hydrogenate about 20 to 90%, preferably about 30 to 85% of the aromatic rings present in the thermal-treated product oil, said product oil being obtained in thermal treating at about 430° to 600° C., preferably about 450° to 550° C. for about 10 to 120 minutes by using a catalytic-cracked or reformed product boiling higher than about 200° C., said residue being obtained from catalytic cracking or catalytic reforming of a petroleum feedstock. The hydrogenated oils have a boiling point higher than about 350° C., preferably about 350° to 600° C.

Any process for hydrogenating aromatic rings to obtain the foregoing hydrogen-donor substances (I) or (II) may be employed. Hydrogenation under an atmosphere of hydrogen in the presence of a conventional catalyst having hydrogenating activity may usually be employed. Although any hydrogenation catalysts may be employed, however, conventional hydrogenation catalyst for use in hydrotreating petroleum feedstocks may be conveniently used. A typical example of such catalysts include a hydrogenation catalyst comprising a composite of one or more Group V to Group VIII active components of the Periodic Table, and an inorganic oxide support such as alumina, silica-alumina, and cationic exchange zeolite. The active component of the hydrogenated catalyst usually comprises a nickel, cobalt, molybdenum, vanadium or tungsten component, said metal component generally being in the form of oxide or sulfide.

Aromatic ring hydrogenation catalysts, for use in hydrogenating aromatic rings, comprising an active component and inorganic oxide support such as active carbon, alumina, silica-alumina, kieselguhr or zeolite may also be employed. Typical examples of the active component of aromatic ring hydrogenation catalysts include nickel, nickel oxides, nickel-copper, platinum, platinum oxides, platinum-rhodium, platinum-lithium, rhodium, vanadium, cobalt, Raney cobalt, ruthenium, and the like. Hydrogenation conditions for producing the foregoing hydrogen-donor substances (I) or (II) are as follows: a temperature of about 300° to 400° C. and a pressure of about 30 to 150 atm. for hydrotreating catalysts, and a temperature of about 150° to 300° C. and a pressure of about 30 to 150 atm. for aromatic ring hydrogenation catalysts.

The hydrogen-donor substance may be added in an amount of about 0.1 to 50 parts by weight, preferably about 0.3 to 30 parts by weight, based on the heavy hydrocarbon oil feedstock (A) weight.

The hydrogen-donor substance is preferably added while stirring the heavy hydrocarbon oil feedstock. However, any blending method may be employed providing that the heavy hydrocarbon oil feedstock (A) and the hydrogen-donor substance can be subjected to thermal cracking in a homogeneous state.

The hydrogen-donor substance of the present invention may be manufactured in a separate plant from the thermal cracking units of the present invention, and furnished as a commercially available additive. The hydrogen-donor substance may also be produced in a plant integrated with the thermal cracking units of the present invention by using part of the thermal-cracked products as its feedstock. The thermal-cracked products from the heavy hydrocarbon oil feedstock (A) may be if desired be further thermal-treated, prior to hydrogenation, in the hydrogen-donor manufacturing plant.

Any hydrogenation reactor such as a fixed-bed or a batchwise reactor may be employed.

Hydrogenated aromatics (%) is determined by calculation according to the following equation, wherein the carbon number of the aromatic ring is defined as that definition shown in ASTM D-2140-66.

$$\text{Hydrogenated Aromatics (\%)} = \frac{\left(\begin{array}{c}\text{Number of}\\ \text{aromatic rings}\\ \text{before}\\ \text{hydrogenation}\end{array}\right) - \left(\begin{array}{c}\text{Number of}\\ \text{aromatic rings}\\ \text{after}\\ \text{hydrogenation}\end{array}\right)}{\left(\begin{array}{c}\text{Number of}\\ \text{aromatic rings}\\ \text{before hydrogenation}\end{array}\right)} \times 100$$

"Hydrogen-donor substance" of the present invention refers to a substance which can transfer hydrogen to anthracene (hydrogen acceptor) in an amount of at least 0.1 hydrogen atom/mole-anthracene at 350° C., as measured by the following test method.

Measurement of Hydrogen Donating Ability

Into an autoclave fitted with a stirrer is placed a certain amount of sample and anthracene (sample/anthracene=½). The mixture is reacted under the conditions shown in Table 1.

TABLE 1

| Items | Conditions |
|---|---|
| Temperature, °C. | 350 |
| Pressure, $kg/cm^2 \cdot g$ ($N_2$) | 50 |
| Catalyst | None |
| Apparatus type | 1-L autoclave fitted with stirrer |
| Sample/Anthracene (weight ratio) | 1/2 |

After completion of the reaction, the amounts of 9,10-dihydroanthracene, 1,4,5,8-tertahydroanthracene, 1,4,5,8,9,10-hexahydroanthracene, 1,2,3,4,5,6,7,8-octahydroanthracene and unreacted anthracene are measured by gas chromatography.

In accordance with the method described in Yokono et al. M., Fuel. 60, 607(1981), the amount of hydrogen transferred from the sample hydrocarbon as a hydrogen donor to anthracene (hydrogen atom/mole-anthracene) is calculated from the amounts of foregoing hydrogenated products and the results are reported as hydrogen donating ability of the sample hydrocarbon.

Thermal cracking of the present invention is carried out in an atmosphere of nitrogen under the following conditions:

| | BROAD RANGE | PREFERRED RANGE |
|---|---|---|
| Temperature, °C. | 380–500 | 400–480 |
| Cracking time, (hr) | 10 min.–2 hr. | 20 min.–1.5 hr. |

Hydrocracking conditions of the present invention are as follows:

| | BROAD RANGE | PREFERRED RANGE |
|---|---|---|
| Temperature, °C. | 380–450 | 400–430 |
| Hydrogen partial pressure, atm. | 130–200 | 150 |
| Liquid hourly space velocity, V/V/HR | 0.1–1.0 | 0.2–0.6 |

Examples of the catalyst for use in hydrocracking of the present invention include commercially available hydrocracking catalysts comprising a composite of one or more Group V to Group VIII active components of the Periodic Table, and an inorganic porous oxide support such as alumina, silica-alumina, cation exchange zeolite. The active component of the catalyst usually comprises a nickel, cobalt, molybdenum, vanadium or tungsten component, said component generally being in the form of oxide or sulfide. Among these catalysts, preferred are catalysts comprising an active component selected from the group consisting of nickel, cobalt, molybdenum and mixtures thereof and an inorganic oxide support.

The invention will now be illustrated by the following Examples:

EXAMPLE 1

In a 1-L autoclave fitted with an inner stirrer a sample of Middle East vacuum residue was cracked as specified in Table 2 at 420° C. for one hour under an atmosphere of nitrogen in the presence of the following additive (10 parts by weight) to the heavy hydrocarbon oil feedstock (100 parts by weight):

TABLE 2

Properties of Middle East Vacuum Residue used in This Invention

| Items | Properties |
|---|---|
| Sp. Gr. (25° C.) | 1.028 |
| Kinematic Viscosity cSt | |
| @ 120° C. | 919.5 |
| @ 160° C. | 140.8 |
| Flash Point, COC, °C. | 341 |
| Carbon Residue, wt. % | 21.86 |
| Ash, wt. % | 0.04 |
| Penetration, 25° C. | 71 |
| Softening Point, °C. | 43.1 |
| Asphaltenes, wt. % | 8.2 |
| Elementary Analysis, wt. % | |
| C | 84.2 |
| H | 10.5 |
| N | 0.4 |
| S | 4.8 |
| H/C (Element Ratio) | 1.49 |
| Metals, wppm | |
| V | 137 |
| Ni | 46 |
| Fe | 20 |

Experimental Additive 1

A sample of vacuum distillate boiling between 350° C. and 580° C. was heated at 470° C. for 30 minutes. After removing the solid matter followed by distilling off the lighter fraction (b.p. <350° C.), the residual liquid product was hydrogenated in the presence of a Co-Mo/alumina catalyst at a temperature of 380° C., a pressure of 115 atm. and a LHSV of 0.12 ($hr^{-1}$). The resulting hydrogenated product was distilled to remove the lighter fraction, with the resulting liquid product (b.p. >330° C.) being used directly as an additive of the present invention.

The hydrogenated aromatics (%), as measured by $^{1}H$-NMR and $^{13}C$-NMR, of the additive was 65%, and the hydrogen donating ability according to the foregoing method was 0.8 hydrogen atom/mole-anthracene.

Comparative Example 1

The procedure in Example 1 was followed but without addition of the additive.

Table 3 gives experimental results of Example 1 and Comparative Example 1.

EXAMPLE 2

In the foregoing 1-L autoclave fitted with an inner stirrer was cracked a sample of Middle East vacuum residue specified in Table 2 at 430° C. for one hour under an atmosphere of nitrogen in the presence of the following additive (5 parts by weight) to the heavy hydrocarbon oil feedstock (100 parts by weight):

Experimental Additive 2

A sample of DCO (decant oil) in FCC was heated at 480° C. for 10 minutes. After removing the solid matter followed by distilling off the lighter fraction (b.p. <350° C.), the residual liquid product was hydrogenated in the presence of a commercially available desulfurization catalyst (Ni-Mo/alumina) at a temperature of 370° C., a pressure of 100 atm. and a LHSV is 0.10 ($hr^{-1}$). The resultant hydrogenated product was distilled to remove the lighter fraction and the liquid product boiling higher than 350° C. was collected. Hydrogenated aromatics (%) measured by $^{1}H$-NMR and $^{13}C$-NMR of the product was 57%. The amount of hydrogen transferred to anthracene was 1.20 hydrogen atom/mole-anthracene.

Comparative Example 2

The procedure in Example 2 was followed but without use of the additive. Table 3 gives experimental results of Example 2 and Comparative Example 2.

TABLE 3

Yields of Cracked Products

| Yields (wt. %) | Example 1 | Comparative Example 1 | Example 2 | Comparative Example 2 |
|---|---|---|---|---|
| $C_1$–$C_2$ | 1.30 | 1.41 | 2.15 | 2.22 |
| $C_4$, $C_5$ | 0.42 | 0.44 | 0.24 | 0.29 |
| IBP–150° C. | 2.13 | 1.81 | 4.31 | 4.04 |
| 150–250° C. | 2.49 | 2.31 | 4.90 | 4.69 |
| 250–325° C. | 4.80 | 4.44 | 9.49 | 9.11 |
| 325–545° C. | 13.57 | 10.13 | 26.12 | 23.67 |
| >545° C. | 74.47 | 71.03 | 52.63 | 41.46 |
| $H_2S$ | 0.01 | 0.02 | 0.02 | 0.02 |
| $NH_3$ | 0 | 0.01 | 0.01 | 0.01 |
| Insolubles in Toluene | 0.92 | 7.31 | 1.43 | 13.50 |
| Total | 100.11 | 98.91 | 101.30 | 99.01 |

The additives of the present invention exhibited high activity for repressing the formation of toluene insolubles.

It has been known that some hydrogen donors have activity in repressing the formation of toluene insolubles in thermal cracking of heavy hydrocarbon oils. However, the hydrogen donor additives of the present invention exhibited higher activity than the conventional donors even when added in a small amount of 5 parts by weight. This is evidence of the fact that the additives of the present invention have hydrogen donating ability superior to those of the conventional hydrogen donors.

EXAMPLE 3

A sample of Middle East vacuum residue having the characteristics as specified in Table 2 was fed downwardly into a fixed-bed reactor (10 mm in diameter, 0.5 m in height, a 30-$cm^3$ cat.-volume) and cracked in the presence of a commercially available catalyst (Ni-Mo/-silica-alumina) under the following conditions: a temperature of 410° C.; a hydrogen partial pressure of 170 atm.; a LHSV is 0.50 ($hr^{-1}$). In this case, the following substance (5 parts by weight) was added to the heavy hydrocarbon oil (100 parts by weight).

Experimental Additive 3

A sample of vacuum distillate boiling between 350° C. and 580° C. was heated at 470° C. for 30 minutes. After removing the solid matter followed by distilling off the lighter fraction (b.p.<350° C.), the residual liquid product was hydrogenated in the presence of a Co-Mo/alumina catalyst at a temperature of 380° C., a pressure of 115 atm. and a LHSV of 0.12 ($hr^{-1}$).

The resultant hydrogenated product was distilled to remove the lighter fraction, and the liquid product boiling higher than 330° C. was collected. Hydrogenated aromatics (%) measured by $^1$H-NMR and $^{13}$C-NMR of the product was 65%. The amount of hydrogen transferred to anthracene was 0.8 hydrogen atom/mole-anthracene.

Comparative Example 3

The procedure in Example 3 was followed but without addition of the additive. Table 4 gives experimental results of Example 3 and Comparative Example 3.

EXAMPLE 4

A sample of Middle East vacuum residue having the characteristics specified in Table 2 was fed downward into the same reactor employed in Example 3 and Comparative Example 3 and cracked in the presence of a commercially available hydrocracking catalyst (Ni-Co-Mo/silica-alumina) under the following conditions: a temperature of 420° C.; a hydrogen pressure of 150 atm.; a LHSV is 0.30 ($hr^{-1}$). The following substance (5 parts by weight) was added to the heavy hydrocarbon oil feedstock (100 parts by weight).

Experimental Additive 4

A sample of DCO (decant oil) in FCC units was heated at 480° C. for 10 minutes. After removing the solid matter followed by distilling off the lighter fraction (b.p.<350° C.), the residual liquid product was hydrogenated in the presence of a commercially available desulfurization catalyst (Ni-Mo/alumina) at a temperature of 370° C., a pressure of 100 atm. and a LHSV is 0.10 ($hr^{-1}$). The resultant hydrogenated product was distilled to remove the lighter fraction, and the-liquid product boiling higher than 350° C. was collected. Hydrogenated aromatics (%) measured by $^1$H-NMR and $^{13}$C-NMR of the product was 57%. The amount of hydrogen transferred to anthracene was 1.20 hydrogen atom/mole-anthracene.

Comparative Example 4

The procedure in Example 4 was followed but without use of the additive. Table 4 gives experimental results of Example 4 and Comparative Example 4.

TABLE 4

| | Yields of Cracked Products | | | |
|---|---|---|---|---|
| Yields (wt. %) | Example 3 | Comparative Example 3 | Example 4 | Comparative Example 4 |
| $C_1$–$C_2$ | 3.75 | 3.68 | 4.01 | 3.99 |
| $C_4$, $C_5$ | 1.82 | 1.80 | 2.47 | 2.51 |
| IBP–150° C. | 8.90 | 8.79 | 9.96 | 9.93 |
| 150–250° C. | 9.54 | 0.21 | 13.80 | 13.75 |
| 250–325° C. | 18.36 | 18.15 | 21.11 | 20.89 |
| 325–545° C. | 34.15 | 34.93 | 34.48 | 32.75 |
| >545° C. | 19.88 | 19.05 | 10.25 | 11.02 |
| $H_2S$ | 4.73 | 4.59 | 4.98 | 4.91 |
| $NH_3$ | 0.11 | 0.10 | 0.13 | 0.13 |
| Insolubles in Toluene | 0.09 | 0.68 | 0.14 | 0.99 |
| Total | 101.33 | 100.98 | 101.30 | 100.87 |

The additive of the present invention exhibited high activity in repressing the formation of toluene insolubles.

It has been known that some conventional hydrogen donors have activity in repressing the formation of toluene insolubles in thermal cracking of heavy hydrocarbon oils. However, the hydrogen donor additive of the present invention exhibited higher activity than those of the conventional donors even when added in a small amount of 5 parts by weight. This is evidence of the fact that the additives of the present invention have a hydrogen donating ability superior to those of the conventional hydrogen donors.

In the present invention, the formation of carbonaceous matter is markedly repressed. A most serious matter associated with the commercial operation of heavy hydrocarbon oil thermal cracking or hydrocracking process has been the build-up of carbonaceous matter which limits stable continuous operating duration. In order to maintain the operation in stable state for a period of several months, once-through conversion has to be limited. This results in a decrease in liquid yields.

Accumulated carbonaceous matter usually has to be removed periodically by burning off during a shutdown period. This procedure is obviously tedious and it is desired that such frequency has to be reduced.

The addition of an additive according to the present invention may multiply the continuous operating time in conventional heavy hydrocarbon oil thermal cracking or hydrocracking process double to 20 times due to a marked repressing effect of the additive on the formation of carbonaceous matter.

What is claimed is:

1. A thermal cracking process for converting a heavy hydrocarbon oil into light hydrocarbon fuels, which comprises: to about 100 parts by weight of the heavy hydrocarbon oil feedstock (A) being added about 0.1 to 50 parts by weight of a substance (B) selected from hydrogen-donor substances each of which comprises a hydrogenated oil having a boiling point of about 330°–600° C. and obtained by aromatic ring hydrogenation of a thermal-treated product oil boiling higher than about 200° C., said aromatic ring hydrogenation being conducted so as to hydrogenate about 20 to 90% by weight of the aromatic rings present in the product oil, said thermal treating being conducted at about 430° to 600° C. by using a catalytic-cracked or catalytic-reformed product boiling higher than about 200° C., said catalytic cracking or catalytic reforming being conducted by using a petroleum feedstock and thereafter thermal cracking the composition containing A and B.

2. A hydrocracking process for converting a heavy hydrocarbon oil into light hydrocarbon fuels, which comprises: to about 100 parts by weight of the heavy hydrocarbon oil feedstock (A) being added about 0.1 to 50 parts by weight of a substance (B) selected from hydrogen-donor substances each of which comprises a hydrogenated oil having a boiling point of about 330°–600° C. and obtained by aromatic ring hydrogenation of a thermal-treated product oil boiling higher than about 200° C., said aromatic ring hydrogenation being conducted so as to hydrogenate about 20 to 90% by weight of the aromatic rings present in the product oil, said thermal treating being conducted at about 430° to 600° C. by using a catalytic-cracked or catalytic-reformed product boiling higher than about 200° C., said catalytic cracking or catalytic reforming being conducted by using a petroleum feedstock and thereafter hydrocracking the composition containing A and B.

3. A process for converting a heavy hydrocarbon oil into light hydrocarbon fuels according to claim 1, wherein said heavy hydrocarbon oil is selected from any one of the hydrocarbon oils consisting of topped crudes; vacuum residues; oils obtained from coals, oil sands, oil shales, and bitumens.

4. A process for converting a heavy hydrocarbon oil into light hydrocarbon fuels according to claim 1, wherein said petroleum feedstock is selected from any one of the feedstocks consisting of crude oils, vacuum distillates boiling between about 300° C. to 600° C. from crude oils, naphtha cracking residues, catalyst cycle stocks in FCC, catalyst slurry oils in FCC, decanted oils (DCO) in FCC, residues in catalytic reforming of naphtha, crude thermal-cracked tars, and mixtures thereof.

5. A process for converting a heavy hydrocarbon oil into light hydrocarbon fuels according to claim 1, wherein said hydrogenated aromatics of the hydrogen-donor substance is about 30 to 85% by weight.

6. A process for converting a heavy hydrocarbon oil into light hydrocarbon fuels according to claim 1, wherein said boiling point of the hydrogen-donor substance is about 350° to 600° C.

7. A process for converting a heavy hydrocarbon oil into light hydrocarbon fuels according to claim 1, wherein said hydrogen-donor substance is obtained by aromatic ring hydrogenation of the product oil in the presence of a catalyst comprising at least one active metal component selected from Groups V to VIII active components of the Periodic Table in the form of oxide or sulfide, and an inorganic support.

8. A process for converting a heavy hydrocarbon oil into light hydrocarbon fuels according to claim 7, wherein said active metal component is nickel, cobalt, molybdenum, vanadium, or tungsten.

9. A process for converting a heavy hydrocarbon oil into light hydrocarbon fuels according to claim 7, wherein said inorganic support is alumina, silica-alumina or cation exchange zeolite.

10. A process for converting a heavy hydrocarbon oil into light hydrocarbon fuels according to claim 7, wherein said catalyst is an aromatic ring hydrogenation catalyst.

11. A process for converting a heavy hydrocarbon oil into light hydrocarbon fuels according to claim 10, wherein said aromatic ring hydrogenation catalyst comprises an active metal component selected from the group consisting of nickel, nickel oxides, nickel-copper, platinum, platinum oxides, platinum-rhodium, platinum-lithium, rhodium, palladium, cobalt, Raney cobalt and ruthenium, said active metal component being supported on an inorganic support selected from the group consisting of active carbon, alumina, silica-alumina, kieselguhr and zeolite.

12. A process for converting a heavy hydrocarbon oil into light hydrocarbon fuels according to claim 1, wherein said amount of the hydrogen-donor substance to be added is about 0.3 to 30 parts by weight, based on 100 parts by weight of the heavy hydrocarbon oil feedstock (A).

13. A process for converting a heavy hydrocarbon oil into light hydrocarbon fuels according to claim 1, wherein said amount of hydrogen-donor substance added is about 0.3 to 30 parts by weight, said hydrogenated aromatics of the hydrogen-donor substance is about 30 to 85% by weight and said boiling point of the hydrogen-donor substance is about 350°–600° C.

14. A process for converting a heavy hydrocarbon oil into light hydrocarbon fuels according to claim 13, wherein said thermal treating was conducted at 450°–550° C.

15. A process for converting a heavy hydrocarbon oil into light hydrocarbon fuels according to claim 2, wherein said hydrogenated aromatics of the hydrogen-donor substance is about 30 to 85% by weight.

16. A process for converting a heavy hydrocarbon oil into light hydrocarbon fuels according to claim 2, wherein said boiling point of the hydrogen-donor substance is about 350° to 600° C.

17. A process for converting a heavy hydrocarbon oil into light hydrocarbon fuels according to claim 2, wherein said amount of hydrogen-donor substance added is about 0.3 to 30 parts by weight, said hydrogenated aromatics of the hydrogen-donor substance is about 30 to 85% by weight and said boiling point of the hydrogen-donor substance is about 350°–600° C.

18. A process for converting a heavy hydrocarbon oil into light hydrocarbon fuels according to claim 17, wherein said thermal treating was conducted at 450°–550° C.

* * * * *